US012674642B2

(12) United States Patent
Lort et al.

(10) Patent No.: US 12,674,642 B2
(45) Date of Patent: Jul. 7, 2026

(54) AIRSOFT SHOTGUN FIRING MECHANISM

(71) Applicant: Wolverine Airsoft LLC, Kingsport, TN (US)

(72) Inventors: Rich Lort, Kingsport, TN (US); Glenn McCroskey, Bristol, VA (US)

(73) Assignee: DISRUPTIVE DESIGN LLC, Kingsport, TN (US)

( * ) Notice: Subject to any disclaimer, the term of this patent is extended or adjusted under 35 U.S.C. 154(b) by 0 days.

(21) Appl. No.: 18/886,326

(22) Filed: Sep. 16, 2024

(65) Prior Publication Data

US 2025/0093126 A1 Mar. 20, 2025

Related U.S. Application Data

(60) Provisional application No. 63/538,808, filed on Sep. 16, 2023.

(51) Int. Cl.
*F41B 11/89* (2013.01)
*F41B 11/723* (2013.01)
*F41B 11/73* (2013.01)

(52) U.S. Cl.
CPC ..... *F41B 11/89* (2013.01); *F41B 11/723* (2013.01); *F41B 11/73* (2013.01)

(58) Field of Classification Search
CPC ..... F41B 11/56; F41B 11/57; F41B 11/62; F41B 11/723; F41B 11/71; F41B 11/73; F41B 11/89; F42B 12/382
See application file for complete search history.

(56) References Cited

U.S. PATENT DOCUMENTS 4,137,893 A 2/1979 Beauchamp
5,343,849 A 9/1994 Steer
6,857,422 B2 * 2/2005 Pedicini ..... F04B 9/02 124/63
7,806,113 B2 * 10/2010 Skilling ..... F41B 11/724 124/73
8,286,620 B2 * 10/2012 Williford ..... F41B 11/68 124/75
8,360,042 B2 * 1/2013 Skilling ..... F41B 11/70 124/71
9,638,490 B1 * 5/2017 Shen ..... F41B 11/723
9,835,404 B2 * 12/2017 Shen ..... F41B 11/642
(Continued)

OTHER PUBLICATIONS

Matos, Taina , "International Search Report and Written Opinion", International application No. PCT/US2024/046883, Dec. 30, 2024, 8 pages.

*Primary Examiner* — Michael D David

(57) ABSTRACT

An Airsoft shotgun firing mechanism has been developed that fires the spherical projectiles of each shot sequentially in rapid succession. The shotgun firing mechanism directs the airflow sequentially against each spherical projectile in the shot, thus pushing each spherical projectile out of the barrel of the Airsoft shotgun. The flow rates of the air are balanced for all the spherical projectiles so all of the spherical projectiles are accelerating when the last spherical projectile is fired. By balancing the airflows, the spherical projectiles have essentially the same energy. The relative acceleration of the spherical projectiles out of the shotgun barrel is determined or selected by balancing the size and configuration of a bypass channel versus the number or stack of spherical projectiles to be fired.

11 Claims, 11 Drawing Sheets

(56) References Cited

U.S. PATENT DOCUMENTS

| | | | | |
|---|---|---|---|---|
| 11,125,529 | B2 * | 9/2021 | Yoon | F41B 11/89 |
| 11,287,231 | B2 | 3/2022 | Stoddart et al. | |
| 11,371,799 | B2 | 6/2022 | Chong et al. | |
| 11,796,281 | B1 * | 10/2023 | Chang | F41B 11/55 |
| 12,276,474 | B2 * | 4/2025 | Chang | F41B 11/52 |
| 12,352,548 | B1 * | 7/2025 | Myers | F42B 8/12 |
| 2003/0024520 | A1 | 2/2003 | Dobbins | |
| 2007/0107711 | A1 | 5/2007 | Leal et al. | |
| 2007/0151548 | A1 | 7/2007 | Long | |
| 2011/0132343 | A1 * | 6/2011 | Harrison | F41B 1/00<br>42/111 |
| 2015/0020787 | A1 | 1/2015 | Tseng | |

* cited by examiner

AIRSOFT SHOTGUN FIRING MECHANISM

CROSS-REFERENCE TO RELATED APPLICATIONS

This application claims the benefit of U.S. Provisional Patent Application Ser. No. 63/538,808, filed on Sep. 16, 2023, the content of which is incorporated herein by reference in its entirety.

STATEMENT REGARDING FEDERALLY SPONSORED RESEARCH OR DEVELOPMENT

Not Applicable.

FIELD OF INVENTION

The present general inventive concept pertains to air powered rifles and guns, and more particularly to a firing mechanism for an Airsoft shotgun.

BACKGROUND

Airsoft guns are replica weapons that fire spherical non-metallic pellets, often referred to as "BBs," rather than the lethal ammunition that the replica weapons are based upon. Airsoft gun powerplants are designed to have low muzzle energy ratings so the spherical projectiles have significantly less penetrative and easier stopping capabilities, making them generally safe to be shot with, provided proper protective gear is worn. The term "Airsoft" may also refer to a sport played with these Airsoft guns that is similar to paintball, except that the pellets fired by the Airsoft guns do not leave a color mark like those left by a paintball, and the participants typically play on the honor system of acknowledging when being hit by a pellet from an opponent's Airsoft gun. Along with reduced mess, Airsoft guns are typically cheaper to acquire and operate than paintball guns and can also be used more easily for casual target practice when not engaged in competition. One of the most valued aspects of Airsoft guns is the authentic look of the guns, as the appearance closely adheres to the actual weapons upon which they are replicated.

Airsoft guns typically use an air pump or pre-filled bottled gas dispensed by a firing mechanism designed to release a quick burst of compressed air to propel the spherical projectile through a barrel to exit the Airsoft gun. When an Airsoft gun is configured as a rifle or a pistol, each spherical projectile exits the Airsoft gun as a single shot or event. Even in automatic or rapid-fire operation, the spherical projectiles are propelled from the Airsoft gun one at a time.

In the field of Airsoft guns, numerous challenges arise in providing an Airsoft gun configured to behave as a shotgun, that is, configured to release a group of BBs at essentially the same time as a single shot or event in response to a single trigger pull, rather than one at a time. For example, it is generally understood that, when mimicking the firing behavior of a shotgun, an Airsoft gun should release multiple BBs essentially all at once, such that all or essentially all of the BBs hit a target at essentially the same time. Thus, it is generally understood that each BB should be imparted with the same or similar energy by the firing mechanism, such that the BBs are all propelled from the barrel of the Airsoft gun at approximately the same velocity. However, in most Airsoft guns, the firing mechanism is dependent upon having an airtight or essentially airtight seal formed between a single BB and an entryway to the barrel of the Airsoft gun.

Otherwise, the compressed gas released by the firing mechanism will expand around the BB and continue down the barrel of the Airsoft gun without having imparted sufficient energy to the BB to accelerate the BB to the desired velocity.

If a group of Airsoft BBs is positioned proximate the proximal end of the Airsoft gun for firing all at once down the Airsoft gun barrel, significant losses in pressure of the compressed gas released by the firing mechanism at firing may occur as the compressed gas is allowed to expand into the voids between adjacent BBs and travel ahead of the BBs down the Airsoft gun barrel. This phenomenon results in the requirement for significantly more compressed gas to accelerate the group of BBs than is practical to be carried in a typical Airsoft competition. Furthermore, many conventional Airsoft shotguns have a venturi effect that unevenly distributes the energy among the BBs. The venturi effect may cause one or more of the BBs to have too little energy and others to have too much energy. This venturi effect may cause the BBs to leave the Airsoft gun with different velocities, with the result being that the BBs do not all hit a target at essentially the same time.

Additionally, a potential safety hazard occurs in conventional Airsoft shotguns when less than a full load of BBs is loaded. In this configuration, the BBs exit the Airsoft shotgun with elevated energy, to the point that the BBs may cause harm to a participant who is hit with the BBs.

As can be seen from the above description, there is an ongoing need for simple and efficient devices to more evenly distribute energy among the spherical projectiles in an Airsoft shotgun. The Airsoft shotgun of the present general inventive concept avoids or ameliorates at least one of the disadvantages associated with conventional devices.

BRIEF SUMMARY OF THE INVENTION

According to various example embodiments of the present general inventive concept, a firing mechanism for an Airsoft gun is provided that includes a tube for holding a plurality of Airsoft BB's, the tube connecting an air chamber of the Airsoft gun to a firing zone of the Airsoft gun. A bypass channel is provided also connecting the air chamber to the firing zone, the bypass channel allowing air from the air chamber to bypass one or more of the BB's in the tube as the BB's are fired from the tube.

In one aspect, the present general inventive concept provides an Airsoft shotgun firing mechanism having a housing that forms an air chamber, a firing chamber, and an exit chamber. The housing also forms an inlet in the firing chamber. A median wall separates the air chamber and the firing chamber. The median wall has a tube connecting the air chamber to the firing chamber. The median wall also has a post extending axially into the firing chamber. A shuttle is disposed axially on the post in the firing chamber. A biasing mechanism holds the shuttle adjacent to the median wall. A firing zone connects the firing chamber with the exit chamber. The firing chamber has a bypass channel directed toward the firing zone. A projectile stop is disposed in the exit chamber and adjacent to the firing zone.

In another aspect of the present general inventive concept, an Airsoft shotgun firing mechanism has a housing that forms a firing chamber and an exit chamber. At least two spherical projectiles are disposed in the firing chamber. A firing zone connects the firing chamber with the exit chamber. A bypass channel in the firing chamber directs an airflow against each spherical projectile when in the firing zone to fire the spherical projectiles of each shot sequentially in rapid succession through the exit chamber.

Other systems, methods, features and advantages of the present general inventive concept will be, or will become, apparent to one with skill in the art upon examination of the following figures and detailed description. It is intended that all such additional systems, methods, features, and advantages be included within this description, be within the scope of the present general inventive concept, and be protected by the claims that follow. The scope of the present general inventive concept is defined solely by the appended claims and is not affected by the statements within this summary.

Additional aspects and advantages of the present general inventive concept will be set forth in part in the detailed description, the drawings, and the claims which follow, and, in part, will be obvious from such description, or may be learned by practice of the present general inventive concept.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
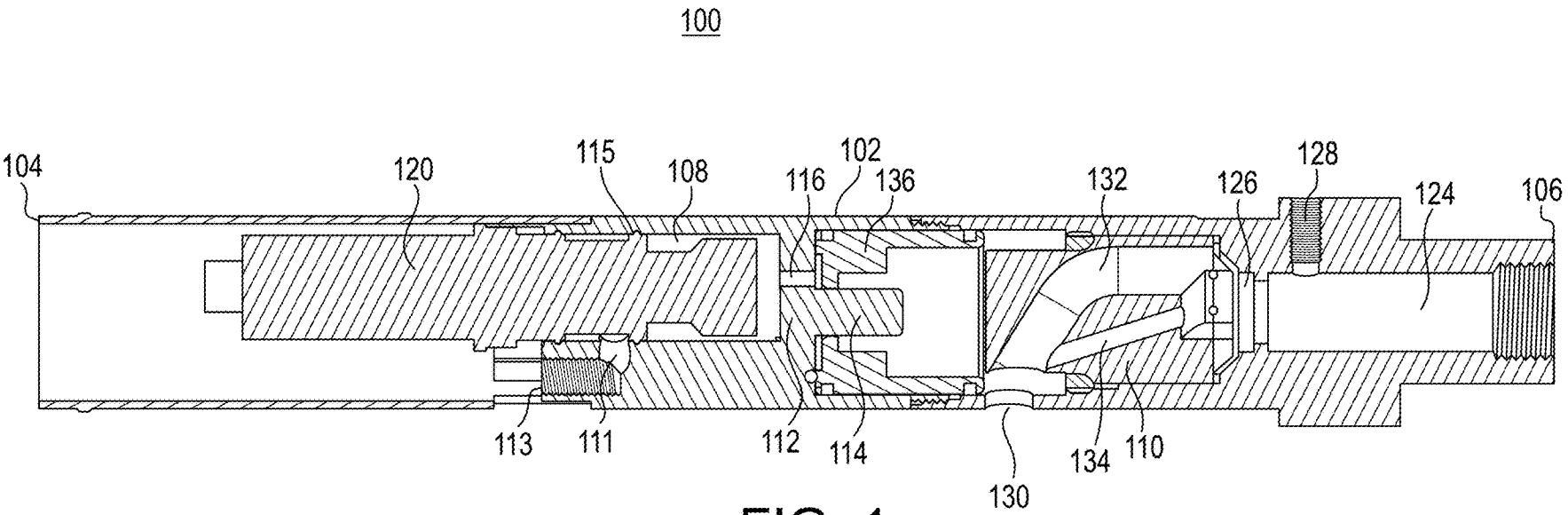
FIG. 1 depicts a side cross-section view of an Airsoft shotgun firing mechanism constructed in accordance with several features of the present general inventive concept.
Figure 2:
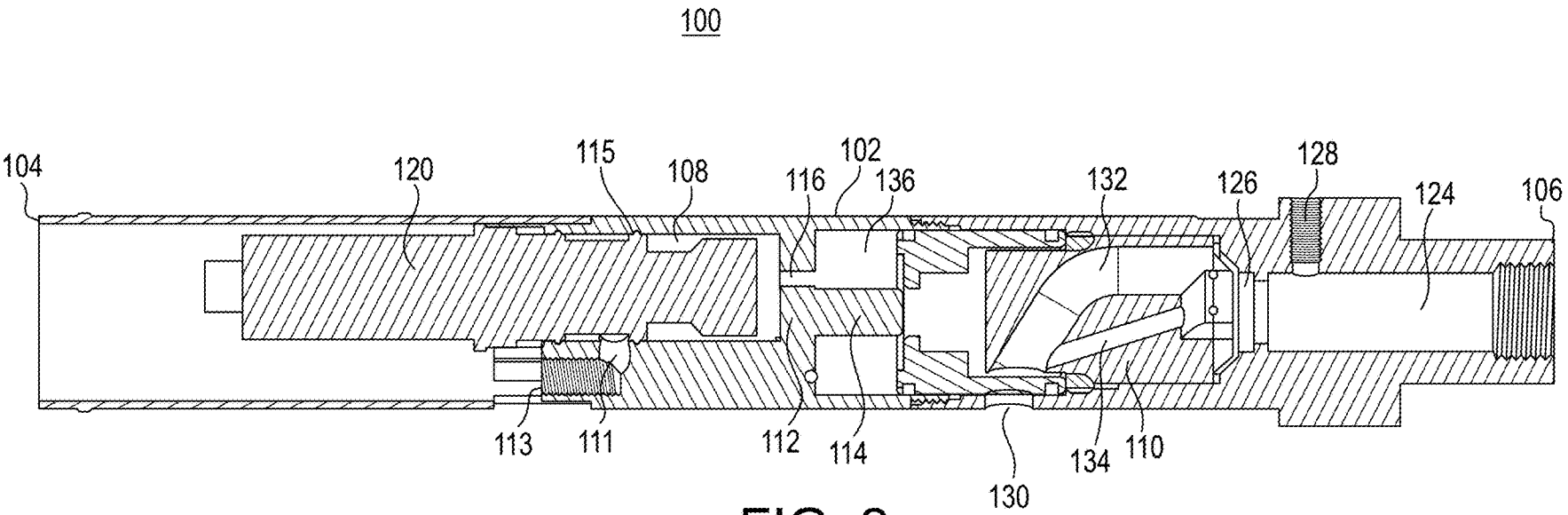
FIG. 2 depicts a cross-section view of the Airsoft shotgun firing mechanism of FIG. 1, showing the Airsoft shotgun firing mechanism in a different configuration.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

To provide a clear and more consistent understanding of the specification and claims of this application, the following definitions are provided.

Unless otherwise indicated, all numbers expressing quantities of ingredients, properties such as amounts, and the like used in the specification and claims are to be understood as indicating both the exact values as shown and as being modified by the term "about". Thus, unless indicated to the contrary, the numerical values of the specification and claims are approximations that may vary depending on the desired properties sought to be obtained and the margin of error in determining the values. At the very least, and not as an attempt to limit the application of the doctrine of equivalents to the scope of the claims, each numerical parameter should at least be construed in light of the margin of error, the number of reported significant digits, and by applying ordinary rounding techniques.

Unless the context clearly dictates otherwise, where a range of values is provided, each intervening value to the tenth of the unit of the lower limit between the lower limit and the upper limit of the range is included in the range of values.

The terms "a", "an", and "the" used in the specification claims are to be construed to cover both the singular and the plural, unless otherwise indicated or contradicted by context. No language in the specification should be construed as indicating any non-claimed element to be essential to the practice of the present general inventive concept.

The simplified diagrams and drawings do not illustrate all the various connections and assemblies of the various components, however, those skilled in the art will understand how to implement such connections and assemblies, based on the illustrated components, figures, and provided descriptions.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, an Airsoft shotgun firing mechanism has been developed that fires two or more spherical projectiles in each shot sequentially in rapid succession. The relative acceleration of the spherical projectiles from the shotgun barrel is determined or selected by balancing the size and configuration of a bypass channel versus the number or stack of spherical projectiles to be fired. The shotgun firing mechanism directs the airflow sequentially against each spherical projectile in the shot, thus pushing each spherical projectile out of the barrel of the Airsoft shotgun while minimizing loss of air pressure between projectiles. The flow rates of air are balanced for all the spherical projectiles so all of the spherical projectiles are accelerating when the last spherical projectile is fired. By balancing the airflows, the spherical projectiles have essentially the same or similar energy. The spherical projectiles may hit a target at essentially the same time or in close succession.

FIGS. 1-7 depict various views of one embodiment shotgun firing mechanism 100 for an Airsoft shotgun. The Airsoft shotgun firing mechanism 100 is contained within a housing 102 having a rear 104 and a front 106. The rear 104 connects to a stock (not shown) with a trigger, electric and/or mechanical controls, of the type commonly associated with an Airsoft gun. The front 106 is connected to a barrel 138 of the Airsoft shotgun.

The housing 102 forms an air chamber 108 disposed toward the rear 104 thereof, and the shotgun firing mechanism 100 forms a firing chamber 110 disposed forward of the air chamber 108. The air chamber 108 and a firing chamber 110 are separated by a median wall 112. The median wall 112 forms a post 114 extending axially into the firing chamber 110 toward the front 106 of the shotgun firing mechanism 100. The median wall 112 also forms a tube 116 connecting the air chamber 108 to the firing chamber 110. An air intake conduit 111 is provided in fluid communication with the air chamber 108 and defines a connector 113 of the type commonly used in Airsoft guns to connect the conduit 111 to a source of pressurized gas, such as for example an air pump, pressurized air canister, or the like.

A valve, such as the illustrated solenoid valve or "solenoid" 120, is disposed in the air chamber 108 and includes an annular gasket 115 encircling a portion of the main body of the solenoid 120 to form a substantially airtight barrier between the air chamber 108 and the remainder of the housing interior rearward of the median wall 112. The solenoid 120 is positioned forward in the housing 102 toward the median wall 112, with the annular gasket 115 positioned between the air chamber 108 and the air intake conduit 111. In this position, the annular gasket 115 limits fluid communication between the air intake conduit 111 and the air chamber 108. The solenoid 120 is operatively connected to an actuating mechanism (not shown) such that, when the trigger of the Airsoft shotgun is activated, a valve in the solenoid 120 is made to permit fluid communication between the air intake conduit 111 and the air chamber 108. Thus, in the activated position of the solenoid 120, the air intake conduit 111 provides pressurized air to the air chamber 108. This pressurized air is permitted to travel from the air chamber 108 through the tube 116 into the firing chamber 110. It will be recognized that other devices may be used to provide pressurized air to the firing chamber 110 such as a controlled-release gas vessel or other devices known to one of skill in the art.

The housing 102 further forms an exit chamber 124 disposed toward the front 106 of the shotgun firing mechanism 100. The exit chamber 124 has a firing zone 126 connected to the firing chamber 110. The firing zone 126 connects to the barrel 138 when the Airsoft shotgun is assembled. The housing 102 has a projectile stop 128 extending into the exit chamber 124 adjacent to the firing zone 126. The projectile stop 128 may, in some embodiments, prevent a spherical projectile from rolling or being pushed down the exit chamber 124 without sufficient air pressure, and once a projectile is fired down the exit chamber 124, the projectile stop 128 may apply backspin to the fired projectile as the projectile moves down the barrel and out of the Airsoft gun. The projectile stop 128 could be an additional elastic interface disposed along the inside circumference of the exit chamber 124, a rib or detent formed by the housing 102 into the exit chamber 124, or the like. Preferably, the exit chamber 124 also defines a flexible, resilient, annular, backward inclined ramp facing toward the firing zone 126, of the type known to one of skill in the art, which allows each projectile to "seat" at the firing zone near the entrance to the exit chamber 124 before being fired into the exit chamber 124 and down the barrel. When the Airsoft shotgun is fired, the spherical projectiles have sufficient air pressure to push past the ramp and projectile stop 128 to exit the Airsoft shotgun.

The housing 102 also forms an inlet 130 that opens into the firing chamber 110. Spherical projectiles 133 (see FIGS. 3 and 4) are loaded or pass through the inlet 130 into the firing chamber 110 from a magazine (not shown) for multiple shots or as a single shot. Each shot contains two or more spherical projectiles 133, and preferably multiple projectiles 133. The firing chamber 110 has a projectile channel 132 extending from the inlet 130 to the firing zone 126. Spherical projectiles 133 move along the projectile channel 132 for sequential firing through the exit chamber 124. The projectile channel 132 alternatively may be incorporated into or formed by the structure or shape of the exit chamber 124. The firing chamber 110 forms a bypass channel that routes air from the air chamber 108 to the firing zone 126. The bypass channel can be provided by a bypass conduit 134 or can be formed by the sides of the firing chamber 110, the sides of the projectile channel 132, a combination, or the like. For example, in one embodiment (not shown), the bypass channel is formed by way of the projectile channel being sized to a larger diameter than the projectiles disposed therein from portions of the projectile channel nearest the inlet 130 to near the firing zone, but constricting to a diameter near that of the projectiles near the firing zone. In other embodiments, such as the illustrated embodiment, a separate bypass conduit 134 is provided. In operation, the bypass channel routes air past some, but not all, of the spherical projectiles 133 disposed in the firing zone 126. The balance of the air carried by the bypass channel to bear pressure against the one or more projectiles 133 nearest the firing zone versus the air carried by the tube to bear pressure against the rear-most projectile in the tube 116 determines the relative acceleration of the spherical projectiles 133 through the exit chamber 124 and out of the Airsoft shotgun barrel 138.

A generally cylindrical shuttle 136 is slidably disposed in the firing chamber 110 and is permitted to slide from a first position, adjacent to the median wall 112, to a second position generally encircling at least a portion of the projectile channel 132. The shuttle 136 has an open forward annular end and a rearward annular end defining a rear wall having an opening defined therein. The post 114 extends axially through the rear wall opening of the shuttle 136, such that when the shuttle is positioned adjacent to the median wall 112, the post 114 and shuttle rear wall cooperate to prohibit fluid communication between the tube 116 and the firing chamber 110. The shuttle 136 is biased or pressed by a spring (not shown) or other biasing mechanism against the median wall 112 in the first position, so as to not block or obstruct the inlet 130, but instead to cooperate with the post to prohibit fluid communication between the tube 116 and the firing chamber 110.

Figure 3:
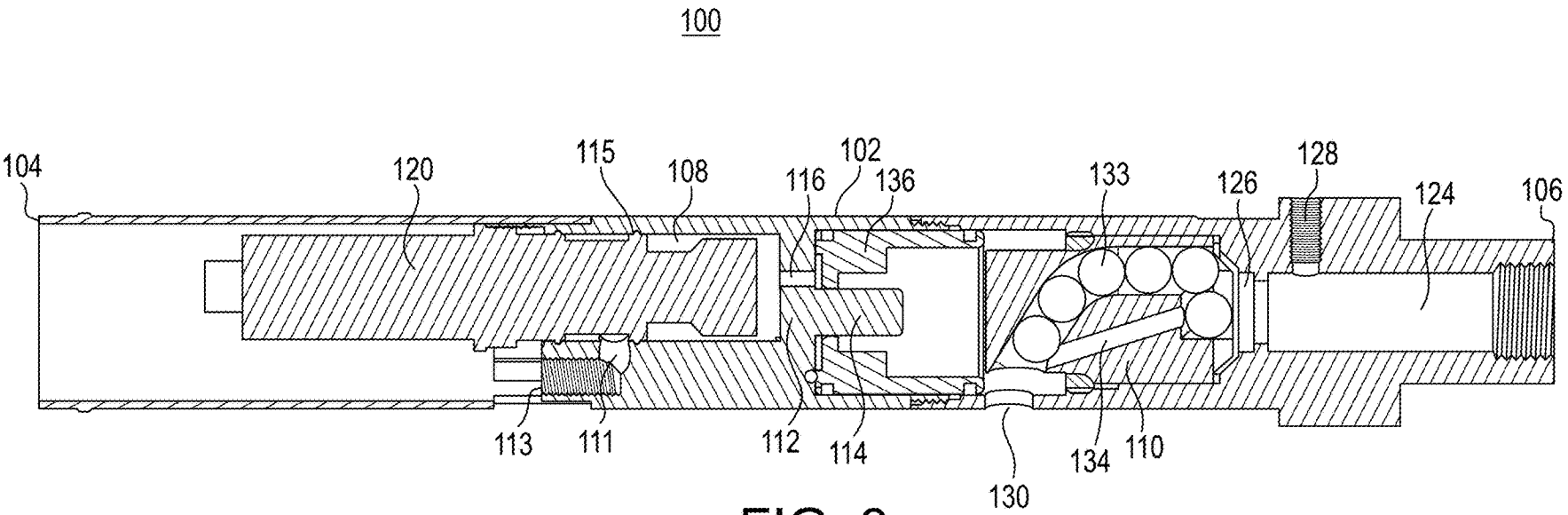
FIG. 3 depicts a cross-section view of the Airsoft shotgun firing mechanism of FIG. 1, together with a plurality of BB's received within the tube.
Figure 4:
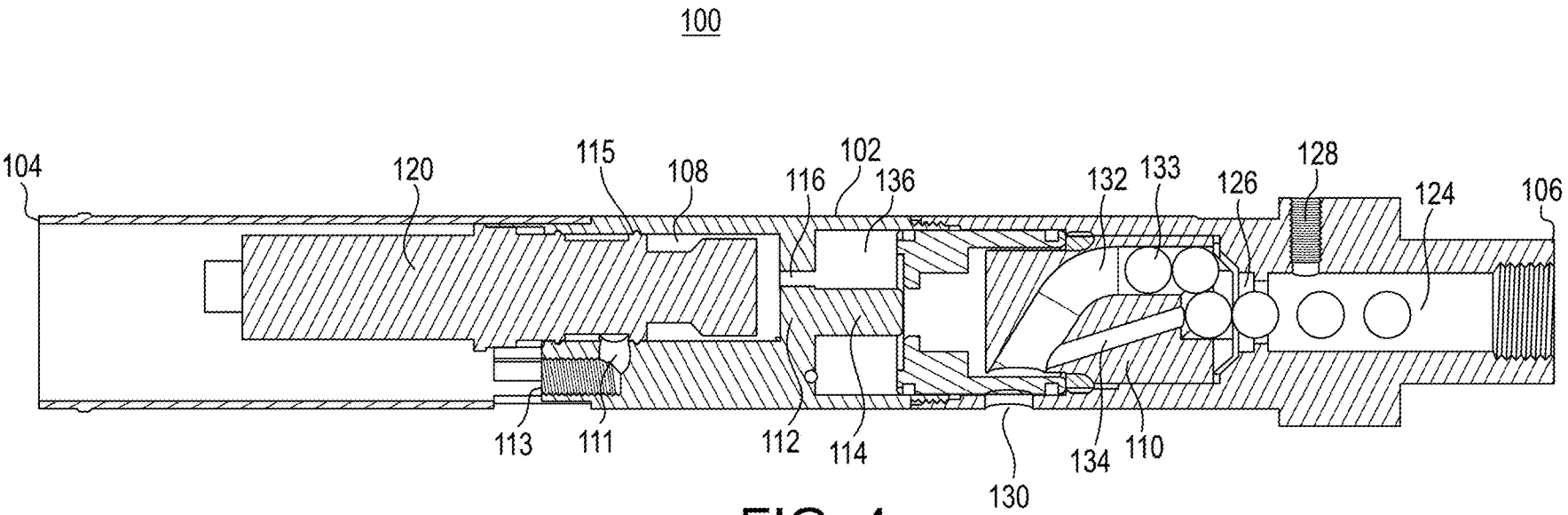
FIG. 4 depicts a cross-section view of the Airsoft shotgun firing mechanism of FIG. 3, showing the BB's being fired from the Airsoft shotgun firing mechanism.
Figure 5:
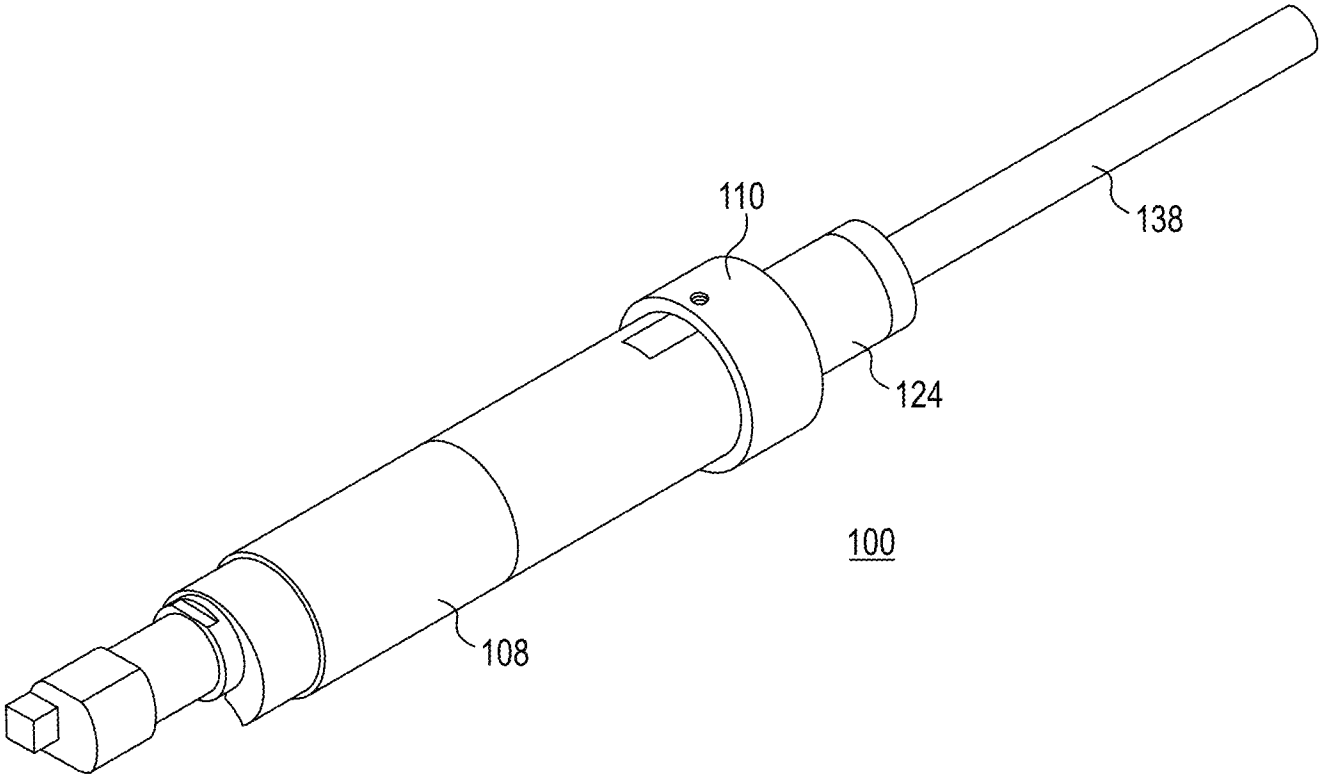
FIG. 5 depicts an assembled perspective view of the Airsoft shotgun firing mechanism of FIG. 1.
Figure 6:
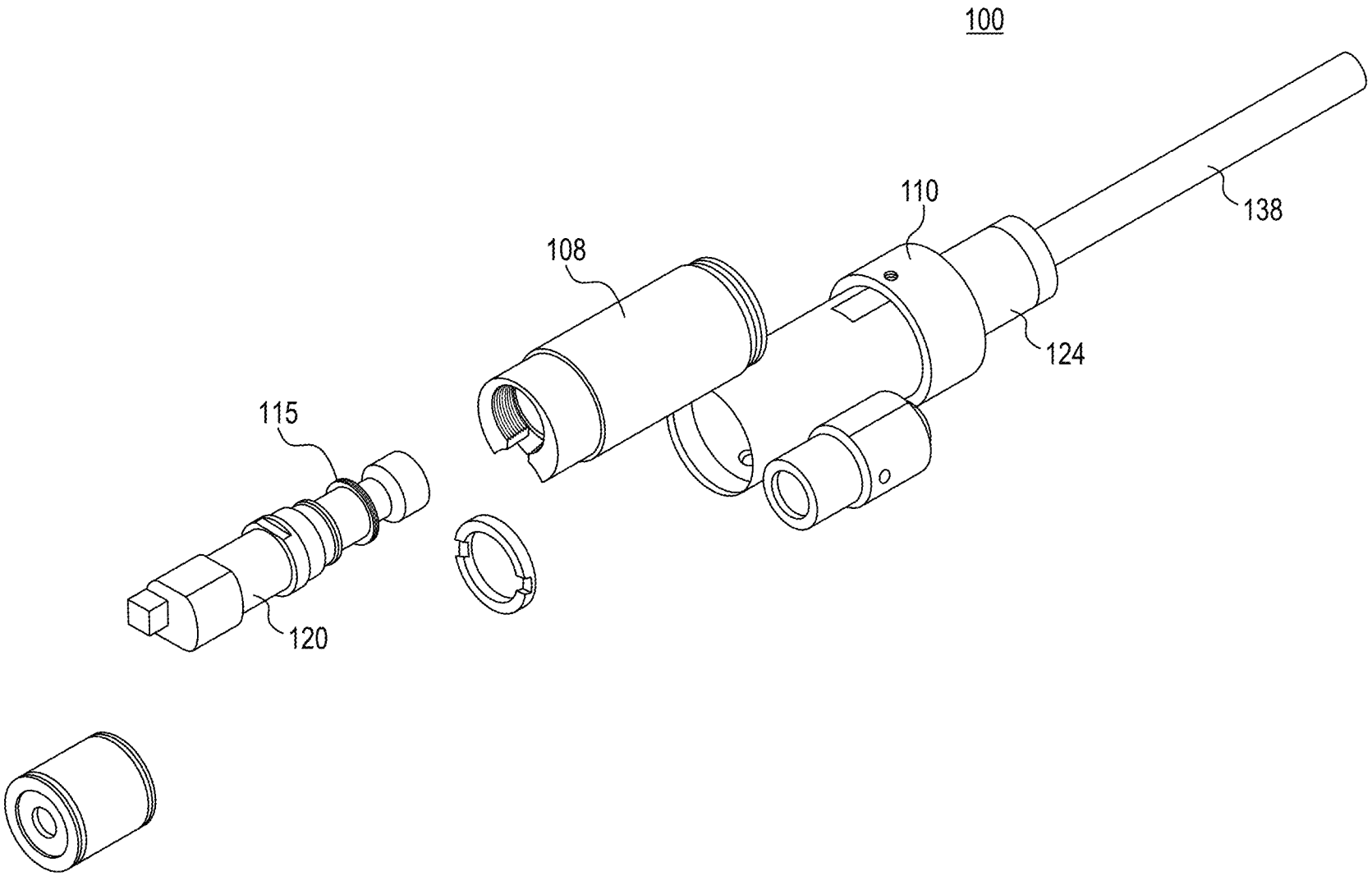
FIG. 6 depicts an expanded perspective view of the Airsoft shotgun firing mechanism of FIG. 1.
Figure 7:
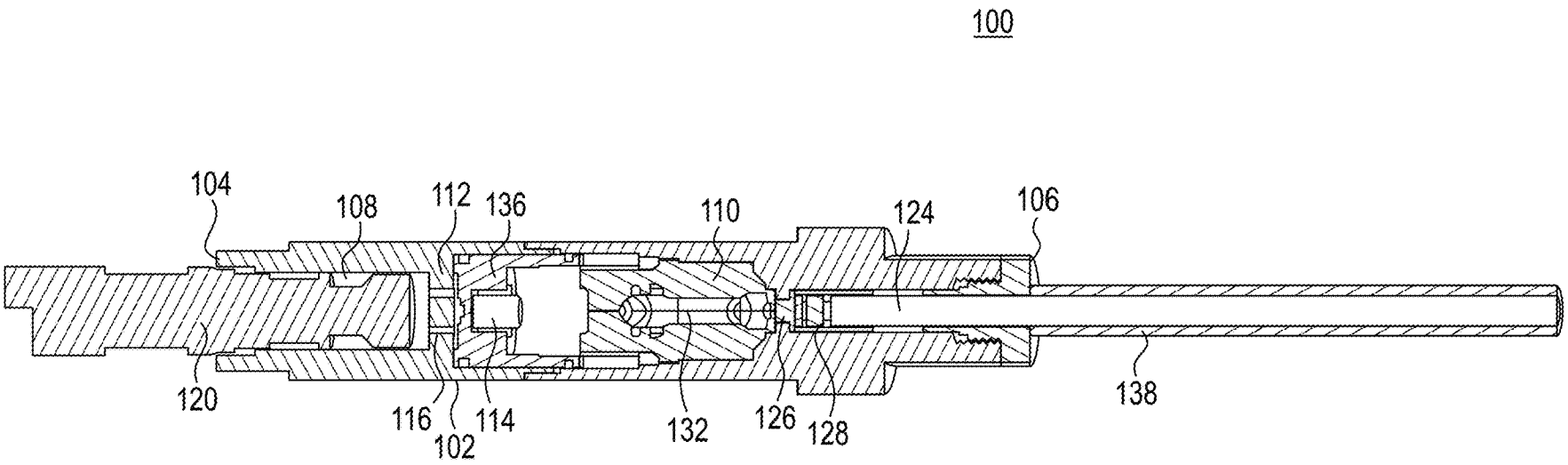
FIG. 7 depicts a top cross-section view of the Airsoft shotgun firing mechanism of FIG. 1.

With reference to FIGS. 3 and 4, when the solenoid 120 is activated and pressurized air is permitted to enter the tube 116 from the air intake conduit 111 and the air chamber 108, the increase in air pressure in the tube 116 causes the shuttle 136 to move against the bias of the spring, away from the median wall 112 and into the second position (see FIG. 4). In this second position, the shuttle 136 blocks or obstructs the inlet 130 to prevent additional spherical projectiles 133 from entering the firing chamber 110. At the same time, the shuttle 136 and the post 114 separate, thereby allowing pressurized air from the tube 116 to travel into the firing chamber 110. Once the pressurized air enters the firing chamber 110, the pressurized air is imparted to each of the projectiles 133 in the projectile channel 132 via the projectile channel 132, and to the first projectile in the projectile channel 132 via both the projectile channel 132 and the bypass channel 134. Thus, the first projectile in the projectile channel 132 is fired into the exit chamber 124 and down the barrel of the Airsoft shotgun, and the remaining projectiles 133 are advanced within the projectile channel 132 such that the second projectile is positioned to receive pressurized air from both the projectile channel 132 and the bypass channel 134. At this point, the second projectile is imparted with sufficient pressurized air from both the projectile channel 132 and the bypass channel 134 to fire the projectile into the exit chamber 124 and down the barrel of the Airsoft shotgun, whereupon the remaining projectiles 133 are advanced within the projectile channel 132, thereby positioning the next projectile to receive pressurized air from both the projectile channel 132 and the bypass channel 134, and so on. Once all of the projectiles within the projectile channel 132 leave the exit chamber 124 and barrel, the firing chamber 110, tube 116, and air chamber 108 are rendered in fluid communication with the exterior of the Airsoft shotgun, and the pressure within these components is allowed to dissipate. In this configuration, the spring bias of the shuttle 136 causes the shuttle to return to its starting position surrounding the post 114 (see FIG. 3), whereupon the shuttle 136 is no longer blocking additional BB's from entering the projectile channel 132 through the inlet 130. Additional BB's are allowed to enter the projectile channel 132 through the inlet 130, and the Airsoft shotgun firing mechanism 110 is thus made ready for the next shot.

In operation, a shot is loaded or enters the projectile chamber 132 of the firing chamber 110. Each shot comprises two or more spherical projectiles 133, which could be any of the typical projectiles used in Airsoft guns. Preferably, two to ten spherical projectiles are loaded for each shot. More preferably, seven spherical projectiles are loaded for each shot. The spherical projectiles may come from an attached magazine that can provide multiple shots or may come from a single shot loaded into the firing chamber 110.

The spherical projectiles 133 move along the projectile channel 132 to position the first spherical projectile in the firing zone 126. The first spherical projectile is held in the firing zone 126 or is prevented from moving farther into the exit chamber 124 by the projectile stop 128. When the Airsoft shotgun is operated or triggered, the valve of the solenoid opens to allow pressurized air from the air intake conduit 111 to pressurize the air chamber 108 and the tube 116, which pushes the shuttle 136 farther into the firing chamber 110 and toward the exit chamber 124. The shuttle 136 moves into position to block the inlet 130 and to prevent any further spherical projectiles 133 from entering the firing chamber 110.

When the shuttle 136 moves or is pushed past the post 114, the air enters the firing chamber 110 and propels the spherical projectiles out of the firing chamber 110, into the exit chamber 124, and out of the barrel 138. The airflow is directed by the bypass channel 134 against the first or first few spherical projectiles in the firing zone 126. Pressure from both the projectile channel 132 and the bypass channel 134 pushes the first spherical projectile past the projectile stop 128, through the exit chamber 124, and out of the barrel 138 of the Airsoft shotgun. Pressure from the projectile channel 132 causes the remaining spherical projectiles within the projectile channel 132 to advance and the next spherical projectile to enter the firing zone 126 as the first spherical projectile leaves, and this next spherical projectile is similarly pushed by the air from both the projectile channel 132 and the bypass channel 134 past the projectile stop 128, through the exit chamber 124, and out of the barrel 138 of the Airsoft shotgun. The remaining spherical projectiles advance, thereby entering and leaving the firing zone 126 in similar fashion as the first projectiles. A shot is completed when no spherical projectiles remain in the firing chamber. At this point, air pressure within the firing chamber 110 and the tube 116 depletes, causing the shuttle 136 to return to position against the median wall 112 and opening the inlet 130 for another shot having more spherical projectiles 133 to enter the firing chamber 110. The solenoid 120 and triggering mechanism of the Airsoft shotgun return to their original configuration, and the process may begin again.

The shotgun firing mechanism 100 fires the two or more spherical projectiles of each shot sequentially in rapid succession. The spherical projectiles may hit a target at essentially the same time. The shotgun firing mechanism 100 avoids having the elevated energy of one or more spherical projectiles when less than a full load of spherical projectiles is used because the energy per spherical projectile from the shotgun firing mechanism 100 is very similar, essentially the same, for all the spherical projectiles in the same shot. Preferably, the shotgun firing mechanism 100 completely fires all the spherical projectiles in a single shot within one (1.0) second or less. More preferably, the shotgun firing mechanism 100 completely fires all the spherical projectiles in a single shot within approximately twenty (20) milliseconds or less.

The relative acceleration of the spherical projectiles out of the shotgun barrel is determined or selected by balancing the size and configuration of the bypass channel in relation to the number or stack of spherical projectiles to be fired. The flow rates of the air flowing through the channel bypass are balanced for all the spherical projectiles 133 so all of the spherical projectiles are accelerating when firing the last spherical projectile in a shot. The size and configuration of the bypass channel 134 controls the energy of each spherical projectile, which is essentially the same for each spherical projectile 133 in a shot regardless of the number of spherical projectiles in the shot. By balancing the airflows, the spherical projectiles have essentially the same energy thus avoiding the hazard of elevated energy even when less than a full load of spherical projectiles is used in a shot.

Figure 8:
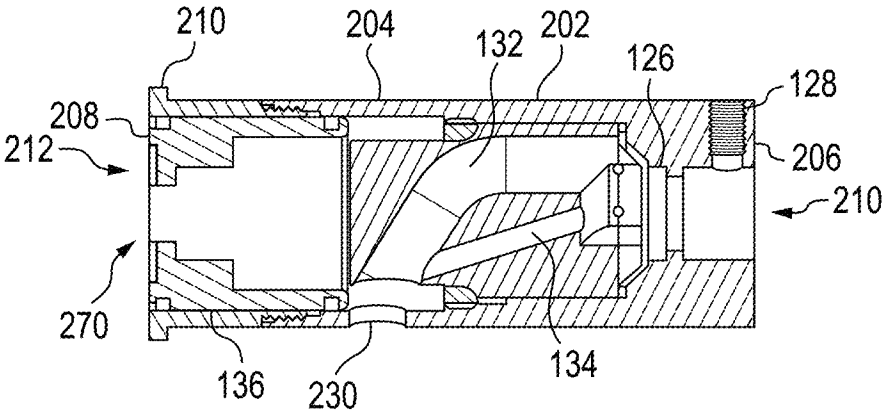
FIG. 8 depicts a side cross-section view of a portion of an Airsoft shotgun firing mechanism constructed in accordance with several features of the present general inventive concept.
Figure 9:
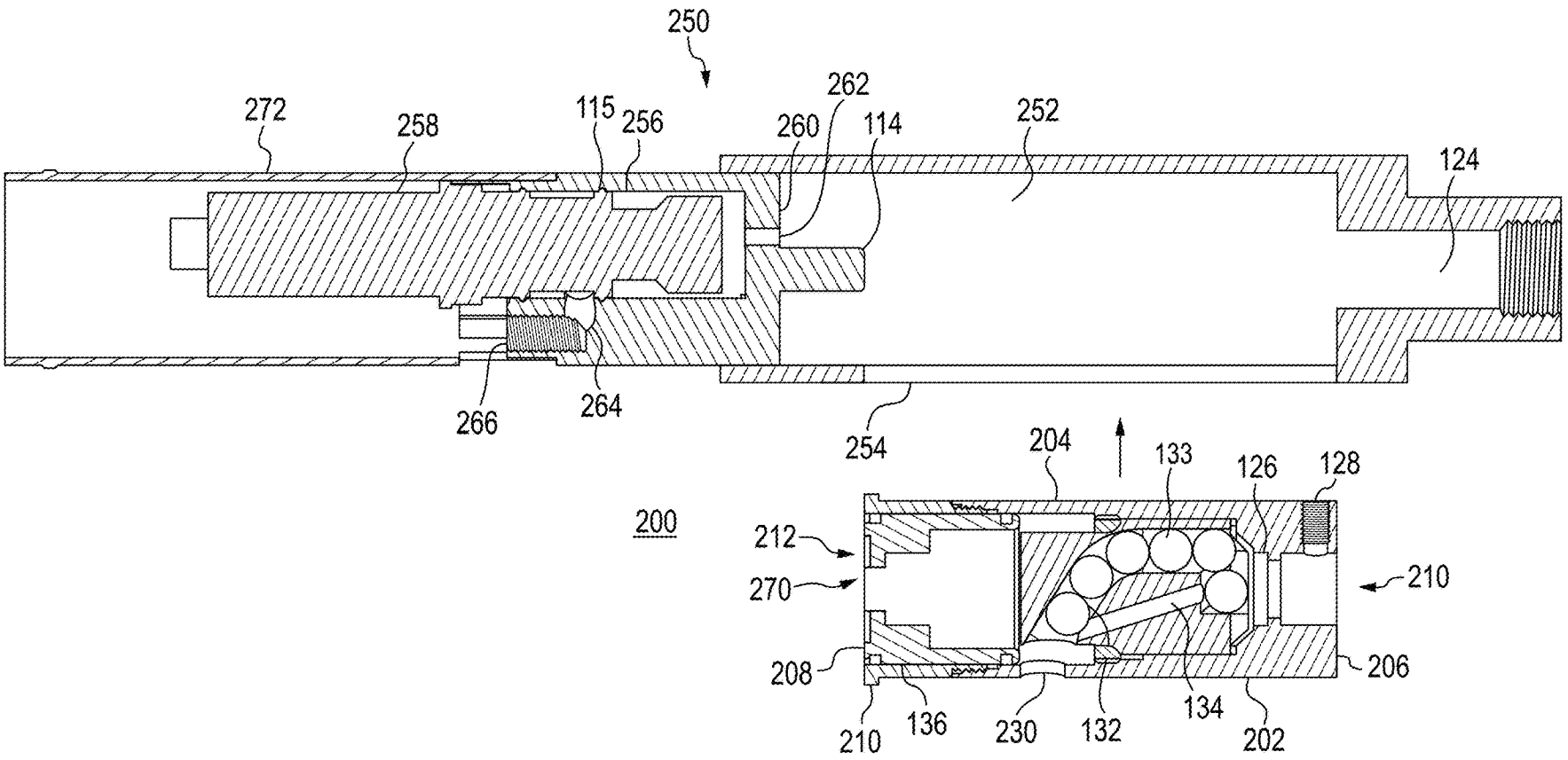
FIG. 9 depicts a partially-expanded side cross-section view of another embodiment Airsoft shotgun firing mechanism constructed in accordance with several features of the present general inventive concept.
Figure 10:
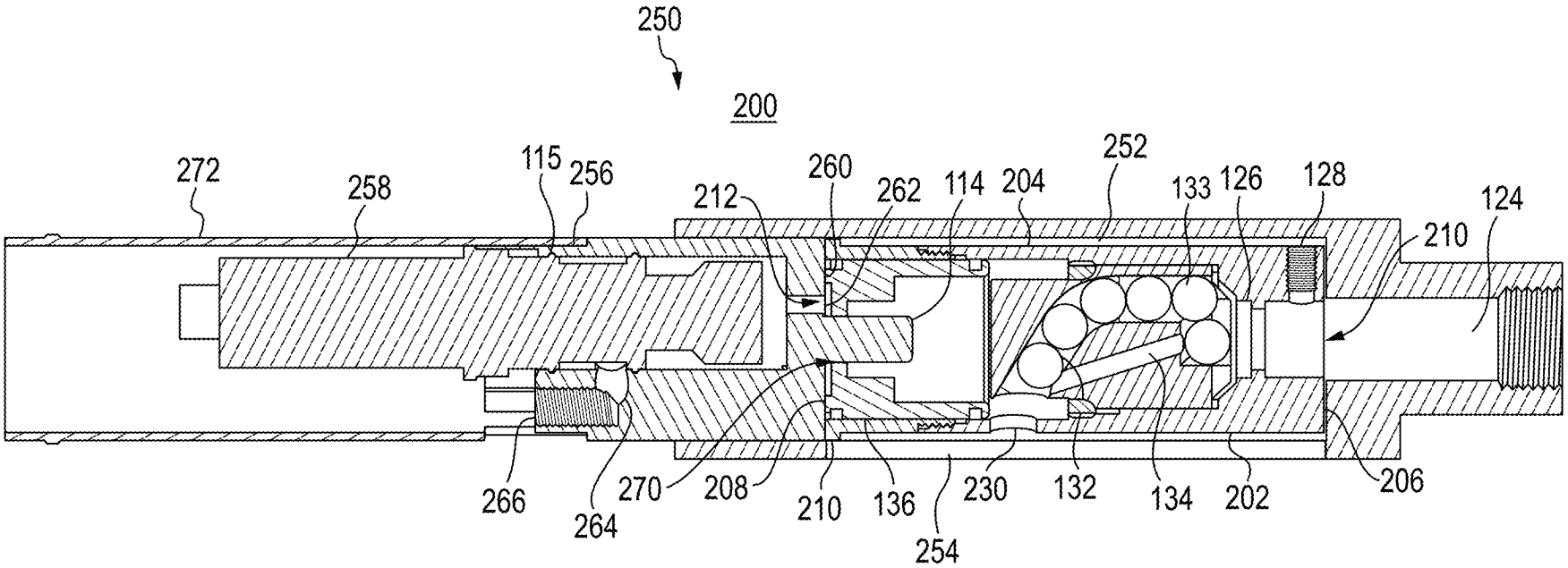
FIG. 10 depicts an assembled side cross-section view of the Airsoft shotgun firing mechanism of FIG. 9.

FIGS. 8-10 illustrate another embodiment of a shotgun firing mechanism 200 constructed in accordance with several features of the present general inventive concept. In the embodiment of FIG. 8, a portion of the shotgun firing mechanism 200 is provided within a discrete shell 202 which is sized and shaped to resemble a shotgun shell. More specifically, the shell 202 comprises a generally cylindrical curved outer side wall 204 having a generally circular forward end wall 206 and a generally circular rearward end wall 208. The rearward end wall 208 defines an outwardly-projecting annular lip 210 extending along the intersection of the outer side wall 204 and the rearward end wall 208, the lip 210 resembling a rim portion of a shotgun shell.

In the illustrated embodiment, the forward end wall 206 defines an axially-located annular through opening 210 opening to an interior of the shell 202. The through opening 210 leads to a firing zone 126 of the type described above, having a projectile channel 132 extending from an inlet 230 defined in the side wall 204 to the firing zone 126. A projectile stop 128 is defined in the shell 202 near the forward end wall 206 and is configured to limit free movement of spherical projectiles 133 from within the projectile channel 132 through the firing zone 126 and out the through opening 210. As discussed above, a bypass channel 134 is defined extending between the firing zone 126 and a portion of the projectile channel 132 near the inlet 230.

Within the shell 202, a cylindrical shuttle 136 is provided which is slidably disposed between a first position, in which the shuttle 136 is adjacent the rearward end 208 of the shell 202 and clear of the inlet 230 and projectile channel 132, and a second position, in which the cylindrical shuttle 136 is translated forward of the first position within the shell 202 to substantially block the inlet 230 and at least partially surround the projectile channel 132. As discussed above, the cylindrical shuttle 136 is biased toward the first position, as by a compression spring (not shown) disposed between the shuttle 136 and a forward portion of the shell 202. The rearward end wall 208 of the shell 202 defines an opening 212 which opens to an interior of the shell 202 and which exposes at least a portion of a rearward end of the cylindrical shuttle 136. A rearward end of the shuttle 136 defines an annular through opening 270 which is sized and shaped to receive and fit in substantially airtight registration with a post 114 portion of a firing mechanism (see FIG. 9).

In various embodiments, one or more of a plug, door, panel, or the like may be provided to allow selective opening and closure of the inlet 230. For example, in one embodiment (see FIG. 11), a resilient plug 280 may be provided sized and shaped to fit snugly within the inlet 230 and to establish a frictional connection therewith. Thus, the plug 280 may be removed to allow a user to place one or more spherical projectiles within the projectile channel 132 to establish a full load of projectiles within the shell 202. Thereafter, the plug 280 may be replaced within the inlet 230, thereby at least temporarily "sealing" the load of projectiles within the projectile channel 132 in the shell 202.

With reference to FIGS. 9 and 10, in the present embodiment, further portions of the shotgun firing mechanism 200 are provided by a receiver unit 250 which may be installed within a firing mechanism of an Airsoft shotgun. In the illustrated embodiment, the receiver unit 250 includes a generally cylindrical receiver chamber 252 having a loading port 254 configured to receive a shell 202 therethrough, such that the shell 202 may be positioned generally coaxially within the receiver chamber 252. A forward portion of the receiver chamber 252 defines an exit chamber 124 of the type described above, configured to be secured to a barrel of an Airsoft gun and to allow one or more spherical projectiles to travel through the exit chamber 124 and into the barrel of the Airsoft gun. When the shell 202 is received within the receiver chamber 252 (see FIG. 8), the exit chamber 124 aligns with the through opening 210 of the forward end wall 206 such that projectiles exiting the firing zone 126 may pass through the exit chamber 124 and outward through the barrel of the Airsoft gun.

A rearward portion 272 of the receiver unit 250 is slidably mounted within the firing mechanism of the Airsoft shotgun and includes an air chamber 256 having a solenoid valve 258 or other valve disposed therein, and an annular gasket 115 encircling the solenoid 258 to establish a substantially airtight barrier between the air chamber 108 and portions of the Airsoft shotgun rearward of the solenoid 258. Forward of the air chamber 256, a median wall 260 is provided separating the air chamber 256 from the receiver chamber 252. The median wall 260 forms a post 114 which is sized and shaped to be received within, and to register with, the through opening 270 of cylindrical shuttle 136, such that the post 114 forms a substantially airtight seal between the air chamber 256 and portions of the interior of the shell 202 forward of the cylindrical shuttle 136. The rearward portion 272 is slidable between a first position (FIG. 7), in which the post 114 is retracted axially from the receiver chamber 252 to allow a shell 202 to be received into the receiver chamber 252, and a second position (FIG. 8), in which the post 114 is advanced axially into the receiver chamber 252 to allow the post 114 to be received within the through opening 270 of the cylindrical shuttle 136 to substantially seal the through opening 270. In various embodiments, suitable seals or gaskets may be provided such that positioning the rearward portion 272 of the receiver unit 250 in the second position also forms a substantially airtight seal between the tube 262 connecting the air chamber 256 to the receiver chamber 252 and the rearward surface of the cylindrical shuttle 136.

As discussed above, an air intake conduit 264 is provided in fluid communication with the air chamber 256 and defines a connector 266 of the type commonly used in Airsoft guns to connect the conduit 264 to a source of pressurized gas, such as for example an air pump, pressurized air canister, or the like. Thus, when the Airsoft shotgun is actuated, the solenoid 258 travels rearward of the conduit 264, thereby opening the conduit 264 to fluid communication with the air chamber 256, and thereby pressurizing the air chamber 256. As the air chamber 256 is pressurized, air flows through the tube 262 connecting the air chamber 256 to the receiver chamber 252. Thus, pressurized air within the air chamber 256 pushes against the rearward surface of the cylindrical shuttle 136, thereby urging the cylindrical shuttle 136 forward from the first position to the second position thereof. Once the rearward surface of the cylindrical shuttle 136 clears the post 114, pressurized air from the air chamber 256 is permitted to flow into the firing chamber of the shell 202, whereupon the spherical projectiles are fired from the projectile channel 132, through the inlet 230, and outward through the barrel of the Airsoft gun as discussed above. Upon firing the projectiles, the shell 202 may be removed from the receiver chamber 252, either manually, via an appropriate ejector and ejector port, or by other means of the type known to one of skill in the art. A new shell 202 loaded with additional projectiles may then be received into the receiver chamber 252, and the Airsoft gun may be fired again.

Figure 11:
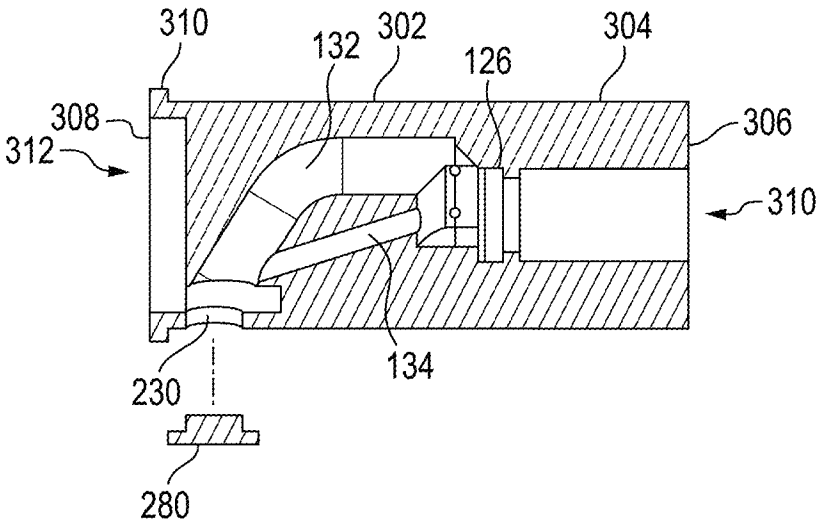
FIG. 11 depicts a side cross-section view of another embodiment of a portion of an Airsoft shotgun firing mechanism constructed in accordance with several features of the present general inventive concept.

FIG. 11 illustrates another embodiment of a shell 302 constructed in accordance with various aspects of the present general inventive concept. Similar to the above-discussed embodiment of FIG. 8, in the embodiment of FIG. 11, the shell 302 comprises a generally cylindrical curved outer side wall 304, a generally circular forward end wall 306, and a generally circular rearward end wall 308 and outwardly-projecting annular lip 310, such that the shell 302 resembles the approximate size and shape of a conventional shotgun shell. However, in the illustrated embodiment, no shuttle 136 is provided within the shell 302. Rather, an open rearward end 312 of the rearward end wall 308 leads directly to an inlet 230, and projectile channel 132, and bypass channel 134. The forward end wall 306 defines an axially-located annular through opening 310 opening directly to the firing zone 126 of the shell 302, forward of the projectile channel 132, and bypass channel 134. As discussed above, a resilient plug 280 is provided that fits snugly within the inlet 230 and establishes a frictional connection therewith. Thus, the plug 280 may be removed to allow a user to place one or more spherical projectiles 133 within the projectile channel 132 to establish a full load of projectiles within the shell 302. Thereafter, the plug 280 may be replaced within the inlet 230, thereby at least temporarily "sealing" the load of projectiles additional projectiles 133 within the projectile channel 132 in the shell 202.

From the foregoing description, it will be recognized by one of skill in the art that the shotgun firing mechanism of the present general inventive concept provides numerous advantages over other firing mechanisms known in the art. For example, the shotgun firing mechanism described herein allows the firing of a rapid series of projectiles having the same, or substantially similar, energy, thereby allowing the projectiles to "travel together" in a manner than mimics shot projectiles fired from a traditional shotgun firearm. In embodiments such as the embodiment shown in FIGS. 6 and 7, the shotgun firing mechanism allows the use of the shotgun firing mechanism in the form of a simulated shotgun shell which may be loaded into an Airsoft gun and fired in a manner similar to the loading and firing of a traditional shotgun firearm, thereby improving the perceived "realism" of the Airsoft shotgun with which the shotgun firing mechanism is used.

While various aspects of the present general inventive concept are described, it will be apparent to those of ordinary skill in the art that other embodiments and implementations are possible within the scope of the present general inventive concept. Accordingly, the present general inventive concept is not to be restricted except in light of the attached claims and their equivalents. Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. An Airsoft shotgun firing mechanism, comprising:

a housing forming an air chamber, a firing chamber, and an exit chamber, where the housing forms an inlet in the firing chamber;

a median wall separating the air chamber and the firing chamber, the median wall having a tube connecting the air chamber to the firing chamber, and the median wall having a post extending axially into the firing chamber;

a shuttle disposed axially on the post in the firing chamber;

a biasing mechanism holding the shuttle adjacent to the median wall;

a firing zone connecting the firing chamber with the exit chamber;

a bypass channel in the firing chamber, the bypass channel directed toward the firing zone; and a projectile stop in the exit chamber and adjacent to the firing zone.

2. The Airsoft shotgun firing mechanism of claim 1, comprising a valve disposed in the air chamber.

3. The Airsoft shotgun firing mechanism of claim 1, where the shuttle has a first position and a second position in the firing chamber, where the first position disposes the shuttle adjacent to the median wall, and the second position disposes the shuttle to block the inlet.

4. The Airsoft shotgun firing mechanism of claim 1, where the projectile stop is a frictional element configured to provide backspin to a projectile.

5. The Airsoft shotgun firing mechanism of claim 1, where the firing chamber has a projectile channel extending from the inlet to the firing zone.

6. The Airsoft shotgun firing mechanism of claim 1, where the firing chamber can hold seven spherical projectiles.

7. The Airsoft shotgun firing mechanism of claim 1, where the bypass channel has a bypass conduit.

8. The Airsoft shotgun firing mechanism of claim 1, where the bypass channel directs an airflow against each spherical projectile when in the firing zone to fire the spherical projectiles of each shot sequentially in rapid succession.

9. The Airsoft shotgun firing mechanism of claim 1, where the energy per spherical projectile in a shot is essentially the same for all the spherical projectiles.

10. The Airsoft shotgun firing mechanism of claim 1, where all the spherical projectiles in a single shot are fired within 1.0 second.

11. The Airsoft shotgun firing mechanism of claim 1, where the size and configuration of the bypass channel are balanced in relation to a number of spherical projectiles to be fired.

* * * * *